US006203291B1

(12) United States Patent
Stemme et al.

(10) Patent No.: US 6,203,291 B1
(45) Date of Patent: Mar. 20, 2001

(54) DISPLACEMENT PUMP OF THE DIAPHRAGM TYPE HAVING FIXED GEOMETRY FLOW CONTROL MEANS

(76) Inventors: Erik Stemme, Prastgardsgatan 18, S-412 71 Gothenburg; Goran Stemme, Brunbarsvagen 1, S-114 21 Stockholm, both of (SE)

( * ) Notice: Subject to any disclaimer, the term of this patent is extended or adjusted under 35 U.S.C. 154(b) by 0 days.

(21) Appl. No.: 08/834,538

(22) Filed: Apr. 4, 1997

Related U.S. Application Data

(63) Continuation of application No. 08/507,251, filed as application No. PCT/SE94/00142 on Feb. 21, 1994, now abandoned.

(30) Foreign Application Priority Data

Feb. 23, 1993 (SE) ..... 9300604

(51) Int. Cl.[7] ..... F04B 17/00

(52) U.S. Cl. ..... 417/413.3; 417/322; 417/413.2; 417/542; 137/833

(58) Field of Search ..... 417/322, 413.2, 417/413.3, 542; 137/833, 842

(56) References Cited

U.S. PATENT DOCUMENTS

| | | | | |
|---|---|---|---|---|
| 3,657,930 | * | 4/1972 | Jacobson | 417/322 X |
| 3,972,656 | * | 8/1976 | Porter | 417/542 |
| 4,555,718 | * | 11/1985 | Aiba et al. | 417/322 X |
| 4,581,624 | * | 4/1986 | O'Connor | 137/831 |
| 4,822,250 | * | 4/1989 | Tsubouchi et al. | 417/322 X |
| 4,826,131 | * | 5/1989 | Mikkor | 417/413.3 X |
| 4,911,616 | * | 3/1990 | Laumann, Jr. | 417/413.1 |
| 5,171,132 | * | 12/1992 | Miyazaki et al. | 417/413.1 |
| 5,259,737 | * | 11/1993 | Kamisuki et al. | 417/322 |
| 5,588,466 | * | 12/1996 | Benz et al. | 137/833 |
| 5,876,187 | * | 3/1999 | Forster et al. | 417/413.2 |

FOREIGN PATENT DOCUMENTS

| | | | | |
|---|---|---|---|---|
| 280618 | * | 5/1952 | (CH) | 417/413.1 |
| 24 10 072 | | 9/1975 | (DE) . | |
| 34 42 325 | | 6/1985 | (DE) . | |
| 378 029 | | 8/1975 | (SE) . | |
| 467 220 | | 6/1992 | (SE) . | |
| 846786 | | 7/1981 | (SU) | 417/322 |
| 8807165 | * | 9/1988 | (WO) . | |

OTHER PUBLICATIONS

Avallone et al.; Marks' Standard Handbook for Mechanical Engineers; p. 3–58, 1987.*

* cited by examiner

*Primary Examiner*—Timothy S. Thorpe
*Assistant Examiner*—Cheryl J. Tyler
(74) *Attorney, Agent, or Firm*—Birch, Stewart, Kolasch & Birch, LLP

(57) ABSTRACT

A displacement pump with a pump housing containing a pump chamber of varying volume, the limiting walls of which includes a moveable portion or diaphragm, the movement and/or deformation of which varies the pump chamber volume. The pump chamber has a fluid inlet on the suction side of the pump and a fluid outlet on the pressure side. Both the fluid inlet and the fluid outlet, or possibly only one of them, includes a flow controlling element having one diffuser and one diffuser inlet which, for the same flow, has a larger pressure drop in one flow direction (the nozzle direction) than in the opposite flow direction (the diffuser direction). A drive element is coupled to the diaphragm, whereby the diaphragm can be caused to oscillate, so that the fluid volume in the pump chamber is caused to pulsate and thereby produce a net flow of fluid through the pump.

14 Claims, 3 Drawing Sheets

DISPLACEMENT PUMP OF THE DIAPHRAGM TYPE HAVING FIXED GEOMETRY FLOW CONTROL MEANS

This application is a continuation of application Ser. No. 08/507,251 filed on Oct. 18, 1995, now abandoned which was filed as PCT/SE94/00142 on Feb. 21, 1994.

FIELD OF THE INVENTION

The present invention relates to a displacement pump of the type comprising a pump housing with a variable volume pumping chamber having an inlet and an outlet for a fluid to be pumped, and a flow control arrangement for controlling the direction of flow through the pump.

BACKGROUND OF THE INVENTION

Displacement pumps of this general type are usually called diaphragm pumps. Such a pump has a pump housing which contains a pump chamber (pump cavity) of variable volume. The pump chamber is defined by walls including at least one elastically deformable wall portion, for example in the form of a flexible diaphragm, which by means of a suitable type of actuator can be provided with an oscillating movement. On the suction side of the pump, there is a fluid inlet to the pump chamber, and, on its pressure side, a fluid outlet from the pump chamber. The fluid flow through the inlet and outlet is controlled by check valves. These check valves can be of many different types. For example, a check valve can be used where the flow-preventing element is a ball or a hinged flap. The check valves are so arranged in the fluid inlet and fluid outlet that the check valve at the inlet is open and the check valve at the outlet is closed during the intake phase (when the volume of the pump chamber is increasing), while the inlet check valve is closed and the outlet check valve is open during the pumping phase (when the volume of the pump chamber is decreasing). The movement and change in shape of the flexible diaphragm causes the volume of the pump chamber to vary, and thus creates the displacement effect, which, thanks to the check valves, is translated into a net flow from the fluid inlet to the fluid outlet, and thus a pulsating flow at the pressure side of the pump (the outlet side).

Pumps with check valves passively controlled by the flow direction and pressure of the pump fluid have, however, certain characteristics which can be disadvantageous, especially in certain applications or fields of use for such pumps.

One example of such disadvantages is the excessively great drop in pressure over the check valves and the risk of wear and fatigue damage to the moving, flow-preventing elements of the valves, which can result in reduced life and reduced reliability of the pump. For pumping, especially sensitive fluids, primarily liquids, there is also the risk that the moving valve elements can damage the fluid or negatively affect its properties.

OBJECTS OF THE INVENTION

For the above applications and special fields of use, there is a pronounced need for pumps which completely lack moving parts, such as check valves, or have only extremely few such moving parts.

The primary purpose of the present invention is therefore to provide a displacement pump of the type described by way of introduction, which can be made completely without valves in the fluid inlet and/or fluid outlet.

The pump is to be a fluid pump which can be used and optimized for pumping both liquids and gases. It must also be able to be used for pumping fluids containing fluid borne particles, e.g. liquids containing solid particles.

SUMMARY OF THE INVENTION

The above mentioned purposes are achieved according to the invention by virtue of the fact that at least one of the fluid inlet and the fluid outlet comprises a constricting element which, for the same flow, has a greater pressure drop over the element in one flow direction, the nozzle direction, than in its opposite, other flow direction, the diffuser direction.

Particularly characteristic for the new type of displacement pump, is that constricting elements with "fixed" geometry are used instead of the check valve(s) used in previously known types of diaphragm pumps, for example.

For the pump according to the invention, in general the wall portion, which through its movement and/or change in shape causes the volume of the pump chamber to vary, can suitably be elastic in itself (i.e. cause its own spring action), but it is also quite possible instead to use a plastically deformable wall portion with a spring or a spring device coupled thereto, which returns the wall portion to its original position. The wall portion can even be the end surface of a reciprocating rigid piston. A pump according to the invention can be made of metal, polymer material, silicon or another suitable material.

In practice, it is suitable that both the fluid inlet and the fluid outlet are made of individual constricting elements of the type described. Both the constricting element of the fluid inlet and the constricting element of the fluid outlet are preferably arranged so that their diffuser direction agrees with the flow direction for the pulse volume flow from the fluid inlet to the fluid outlet.

In general, it can be said that the displacement pump of the invention is given its flow-directing effect by virtue of the fact that the selected type of constricting element has lower pressure losses when the element functions as a diffuser than when it functions as a nozzle. In this connection, it can be pointed out that the term diffuser refers to a flow-affecting element or means which converts kinetic energy of a flowing fluid into pressure energy in the fluid. A nozzle is, in turn, an element or means which, while utilizing a pressure difference (over the nozzle), converts pressure energy in the flowing fluid into kinetic energy.

During the intake phase of the displacement pump (when the pump chamber volume increases), the constricting element on the intake side of the pump of the invention functions as a diffuser with lower flow resistance than the constricting element, functioning at the same time as a nozzle on the outlet side of the pump.

It follows therefrom, that a larger fluid volume is sucked into the pump chamber via the inlet diffuser than via the outlet nozzle during the same suction phase. During the subsequent displacement phase ("pumping phase") of the pump, the constricting element on the inlet side will, instead, function as a nozzle with higher flow resistance than the constricting element on the outlet side of the pump functioning at the same time as the diffuser. This means that a larger volume of fluid is forced out of the pump chamber via the outlet diffuser than via the inlet nozzle during the last mentioned displacement or pumping phase. The result during a complete period (work cycle for the pump) will thus be that a net volume has been moved through the pump, i.e. pumped, from the inlet side to the outlet side, despite the fact that both constricting elements permit a fluid flow in both possible flow directions.

The constriction elements at the inlet and outlet of the pump chamber are preferably directed so that the diffuser directions of the elements agree with the flow direction for the pulsed flow from the fluid inlet and the fluid outlet. The elastically deformable wall portion of the pump chamber consists suitably of one or more flexible membranes, the movement and changing shape of which are achieved by suitable drive means which imparts an oscillating movement to the membrane(s) which causes the fluid volume enclosed in the pump chamber to pulsate. Such a drive means can, for example, be a part of a piezo-electric, electro-static, electromagnetic or electro-dynamic drive unit. It is also possible to use thermally excited membranes.

The pump housing itself, with associated constricting elements, can be made so that they constitute integral parts of an integral piece. The displacement pump according to the invention can also be made by a micro-working process; the pump structure can, for example, be made of silicon.

A pump according to the invention can suitably be made with the aid of micro working methods, especially if the pump is made flat with the constricting elements and the cavity is lying in the same plane. The constricting elements should then be planar, i.e. have a rectangular cross-section.

Micro-working methods refer essentially to those techniques which are used in the manufacture of microelectronics components. This manufacturing concept involves the mass production, from a base substrate (usually monocrystalline silicon), by planar, lithographically defined, thin film technology, small identical components with advanced functions. The term micro-working also encompasses various special processes, such as, for example, anisotropic etching of monocrystalline silicon.

Examples of suitable, inexpensive mass production methods include various types of processes for casting constricting elements and cavities. Possible suitable materials are different types of polymer materials, such as plastics and elastics.

The displacement pump according to the invention can, as can conventional membrane pumps, be provided with pressure-equalizing buffer chambers, both at the pressure side of the pump and at its suction side. With such buffer chambers, the pressure pulses of the pulsed flow can be reduced to a significant extent.

The purposes stated above can be effectively achieved with a displacement pump according to the invention primarily by virtue of the fact that the new pump structure does not need to have any moving parts, and therefore the pump can be made simple and sturdy, and thus guarantee high reliability. The pump according to the invention can be optimized for pumping either gas or liquid, and contain fluid borne particles without impairing the function or reliability of the pump.

A displacement pump according to the invention can, without a doubt, be used within a number of fields. For example, the pump can be used as a fuel pump or a fuel injector in certain types of internal combustion engines. Especially in applications which require a pump with high reliability and small size, the pump according to the invention can be quite suitable. One example of such use is implantable pumps for insulin dosing. Also, fluid handling in analytical instruments for the chemical industry and medical applications can be done with a pump according to the invention.

BRIEF DESCRIPTION OF THE DRAWINGS

The invention will now be explained in more detail below and be exemplified with reference to a number of examples shown in the accompanying drawings.

In the Drawings

DETAILED DESCRIPTION OF THE INVENTION

Figure 1A:
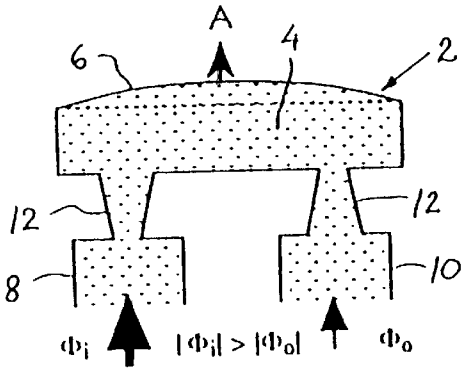
FIGS. 1*a* and 1*b* show the suction and pumping phases for a schematically shown embodiment of a pump according to the invention as seen in vertical section.
Figure 1B:
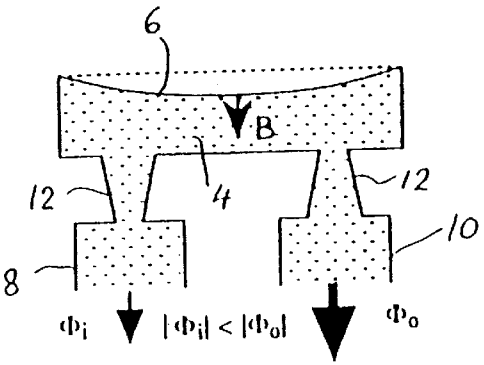

FIGS. 1*a* and 1*b* show schematically a cross-section through a displacement pump according to the invention, in the form of a diaphragm pump. The pump comprises a pump housing 2 with an inner pump chamber 4, the volume of which is variable, and the defining walls of which comprise an elastically deformable wall portion 6 which, in the embodiment shown, is a flexible diaphragm. The diaphragm wall portion 6 moves alternatively out (FIG. 1*a*) and in (FIG. 1*b*), thus varying the volume of the pump chamber, and thus achieving the displacement effect of the pump. On the suction side of the pump, there is a fluid inlet 8 and on the pressure side of the pump, there is a corresponding fluid outlet 10. Both the fluid inlet 8 and the fluid outlet 10 comprise a constricting element 12 which is so designed and dimensioned that, for the same flow, there is a greater pressure drop in one flow-through direction (the nozzle direction) than in the opposite flow-through direction (the diffuse direction). The constricting elements 12 on the inlet (suction) and outlet (pressure) sides of the pump thus only differ to the extent that they are oppositely connected to the pump chamber 4. The constricting elements or the flow control means (12) have a rounded shape at their inlet regions. In FIG. 1*a*, the pump is shown during its suction phase, when the diaphragm wall portion 6 is extended in the direction A, thus increasing the volume of the pump chamber 4. In FIG. 1*b*, the pump is shown during its pumping or displacement phase, when the wall portion 8 is moved inwards in the direction 3, thus reducing the volume of the chamber 4. The inflow and outflow of the pump fluid at the inlet and outlet of the pump are illustrated with the solid arrows $\phi_i$ and $\phi_O$ during the intake phase (FIG. 1*a*) and during the pumping phase (FIG. 1*b*). During the intake phase, the constricting element 12 at the inlet 8 provides a diffuser effect at the same time as the constricting element 12 at the outlet 10 provides a nozzle effect. During the pumping phase, the constricting element 12 at the inlet provides a nozzle effect, while the constricting element 12 at the outlet provides a diffuser effect. During a complete pumping cycle (intake phase+pumping phase), the pump thus produces a net flow from the inlet 8 to the outlet 10.

Figure 2A:
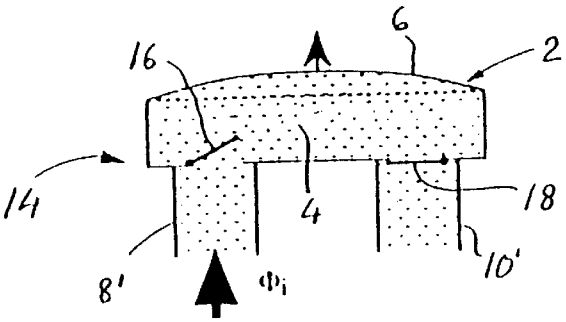
Fig. 2a (Prior art)
FIGS. 2*a* and 2*b* show a cross-section through a conventional check-valve equipped membrane pump in its suction phase and pumping phase.
Figure 2B:
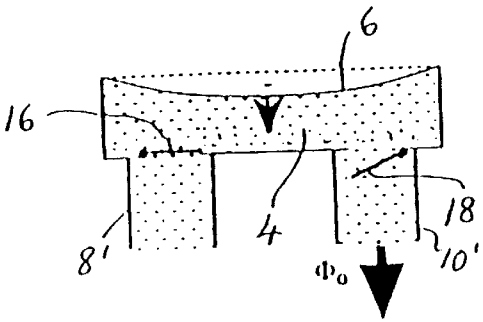
Fig. 2b (Prior art)

FIGS. 2*a* and 2*b* show, for the sake of comparison, a conventional diaphragm pump 14 with passive flap-check valves 16, 18 at the inlet 8' and outlet 10'. These check valves are passively functioning flap valves which are moved between the open and closed positions solely by the movement and pressure of the pump fluid, if one neglects the force of gravity on the valve flaps. During the intake phase (FIG. 2*a*), when the volume of the chamber 4 increases, the valve 16 is open and the valve 18 is closed. During the pumping phase (FIG. 2*b*), when the volume of the chamber 4 is reduced, the check valve 16 is closed and the check valve 18 is open.

Figure 3A:
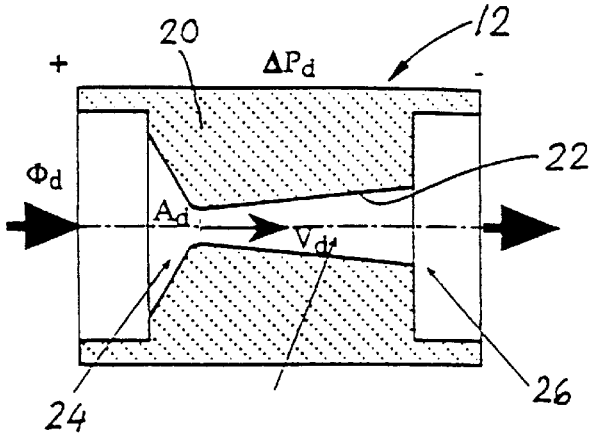
FIGS. 3*a* and 3*b* show in longitudinal section a constricting element according to the invention with through-flow in the diffuser and nozzle directions, respectively.
Figure 3B:
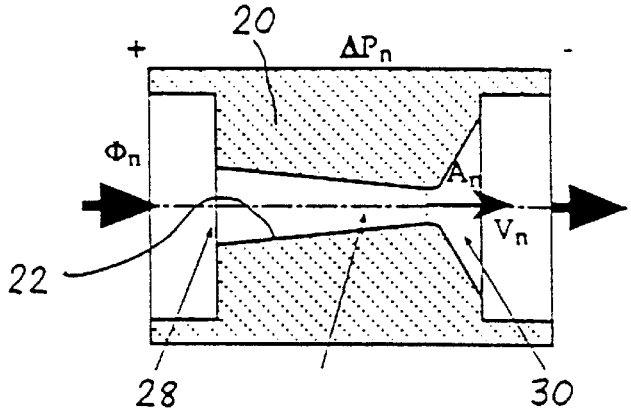

FIGS. 3*a* and 3*b* show an example of a constricting element 12 according to the invention, when there is flow there-through in the diffuser direction (FIG. 3*a*) and the nozzle direction (FIG. 3*b*), respectively. The constricting element 12 is made as a rotationally symmetrical body 20 with a central flow-through passage 22. The flow-through passage 22 extends from an inlet area 24 to an outlet area 26. In FIG. 3*a*, the passage 22 is a diffuser area, while the passage 22 in FIG. 3*b* constitutes a nozzle area. In the latter case, the inlet area, or diffuser inlet portion, consists of the conical entrance 28 to the passage 22, and the outlet area consists of the other end area 30, i.e. the reversed situation to that shown in FIG. 3*a*.

Figure 4:
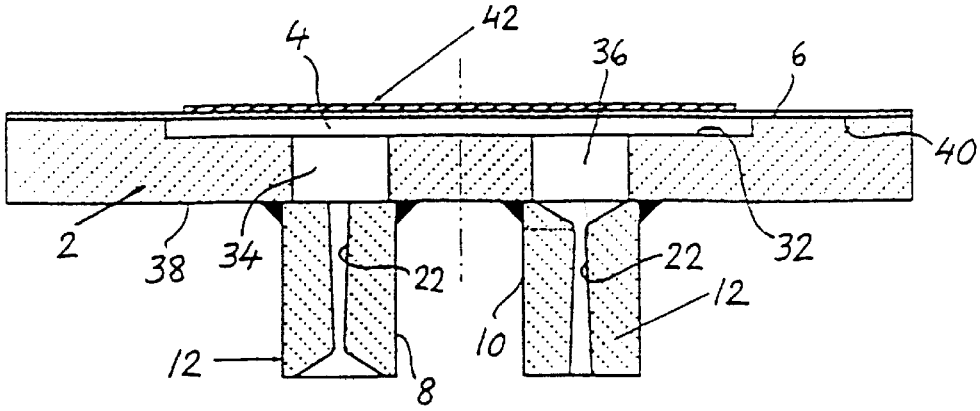
FIG. 4 shows in diametrical cross-section a first embodiment of a pump according to the invention.

Reference is now made to FIG. 4, which shows a diaphragm pump according to the invention. The pump housing 2 consists, in this case, of a circular disc or plate with a shallow, circular cavity 32 which forms the pump chamber 4 in the housing 2. At the bottom Of the cavity 32, there is, firstly, an inlet aperture 34, and, secondly, an outlet aperture 36. The two constricting elements 12 thus constitute the fluid inlet 8 and the fluid outlet 10 of the pump. The pump chamber 4 is sealed at the top 40 of the housing 2 by means of the deformable wall portion 6 of the pump, which is a flexible diaphragm fixed to the pump housing 2. Directly above the pump chamber 4, a piezo-electric crystal disc 42 is fixed to the outside of the diaphragm 6, and is the drive means to impart an oscillating movement to the diaphragm 6, thus causing the fluid volume enclosed in the pump chamber 4 to pulsate. The disc or drive means 42 is, in this case, a portion of a drive unit (not described in more detail here), which drives the wall portion 6 piezo-electrically. In principle, the wall portion or membrane 6 is brought into oscillation by applying an alternating electrical voltage over the piezo-electric crystal disc 42 glued, for example, to the diaphragm. The excitation frequency suitable for driving the pump by means of the piezo-electric disc 42 will be dependent on whether the pump fluid is a gas or a liquid. In a tested pump prototype, an excitation frequency on the order or 6 kHz proved suitable for pumping air, while a frequency of 200 Hz proved suitable for pumping water.

Figure 5:
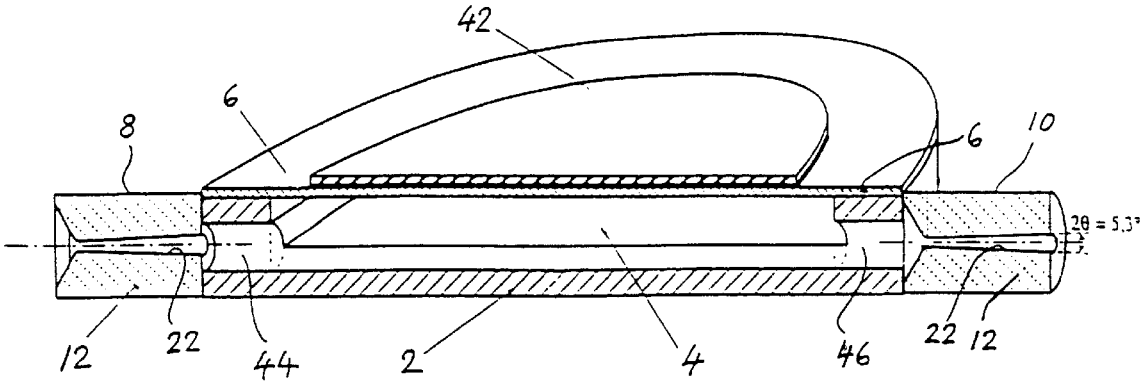
FIG. 5 shows in cross-section and in perspective another embodiment of the pump according to the invention.

FIG. 5 shows a somewhat different embodiment of a displacement pump according to the invention. The basic difference between the embodiments shown in FIGS. 4 and 5 lies in the placement and orientation of the constricting elements 12 forming the fluid inlet 8 and fluid outlet 10 of the pump. In the embodiment according to FIG. 5, the constricting elements 12 extend radially in diametrically opposite directions from the pump chamber 2. The central flow-through passages 22 of the elements 12 are, in this case, in connection with the pump chamber 4 via radial openings 44 and 46 at the inlet 8 and outlet 12 of the pump.

Figure 6:
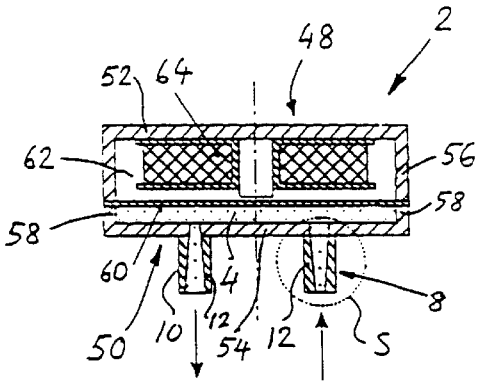
FIG. 6 shows in cross-section a third embodiment of a pump according to the invention.

Finally, FIG. 6 shows an additional embodiment of a diaphragm pump according to the invention. The pump housing 2 is, in this case, in the form of a circular pressure box comprising an upper portion 48 and a lower portion 50 with flat end walls 52 and 54, respectively, and cylindrical and lateral walls 56 and 58, respectively. The lateral walls 56 and 58 are joined from opposite sides to the peripheral edge portion of a diaphragm wall 60 of magnetic material, which, together with the end wall 54 and the lateral wall 58 define the pump chamber 4 within the lower portion 50 of the pump. Within the upper portion 48 of the pump, there is a chamber 62 which houses an electromagnetic drive unit 64, whereby the diaphragm wall 60 can be imparted the oscillating movement required to drive the pump. The two constricting elements 12 of the pump are, in this case, mounted, in principle, in the same manner as in the embodiment shown in FIG. 4.

Figure 7:
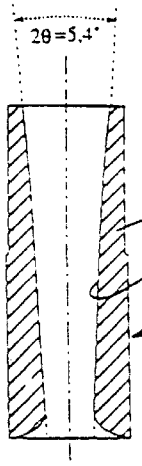
FIG. 7 shows, on a larger scale, the constricting element disposed on the inlet side (within the circle S) of the pump shown in FIG. 6.

FIG. 7 shows in a larger scale the fluid inlet 8 within the circle 5 in FIG. 6. The flow-through passage 22 of the constricting element 12, is in this case, a slightly conical duct with a "point angle" $2\Theta=5.4°$.

Finally, it should be pointed out that there are two main types of diffuser geometries, namely conical and flat wall, which can be used for a pump according to the invention.

A conical diffuser has an increasing circular cross-section, while a flat diffuser has a rectangular cross-section with four flat walls, of which two are parallel. The two diffuser types have approximately the same diffuser capacity. The selection of the diffuser type for the pump according to the invention is therefore essentially dependent on the type of manufacturing process.

Figure 8:
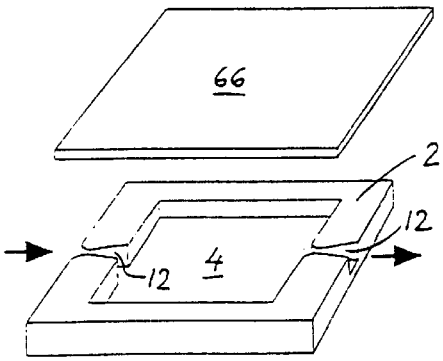
FIG. 8 shows schematically and in perspective a planar pump, the constricting elements of which each have a rectangular cross-section.

FIG. 8 shows a planar pump particularly suited for micro-working processes where the constricting elements 12 are integrated in a single structural piece which also constitutes the pump housing 2 surrounding the pump chamber 4 on four sides. The pump chamber 4 is also, of course, limited by an upper and a lower wall, but in FIG. 1 only the upper wall 66 is shown for the sake of simplicity, and in this Figure it is shown lifted from the pump housing 2. One of these walls is the moveable/deformable wall portion of the pump.

Finally, it should be pointed out that the invention as defined in the following patent claims can, of course, be given many different embodiments differing in various respects from the embodiments described above with reference to the drawings.

We claim:

1. A displacement pump comprising:

a pump housing with a pumping chamber having a variable volume for providing pumping action, said pumping chamber having an inlet and an outlet for a fluid to be pumped wherein a flow passage from the inlet to the outlet is substantially open during the pumping cycle;

a flow control arrangement for controlling the direction of flow through the pump, said flow arrangement comprising in at least one of said inlet and said outlet a flow controlling means;

said flow controlling means having one diffuser inlet portion and one diffuser portion as seen in a direction of flow through the pump, said flow controlling means includes a rounded shape at an inlet region forming a smooth transition from a surrounding wall;

said diffuser inlet portion having walls admitting a converging flow creating a pressure drop from a pressure maximum at an entrance of the flow controlling means, to an entrance of the diffuser portion;

said diffuser portion having diverging walls causing a substantially diverging flow and a pressure increase; and said flow controlling means being adapted, for a given flow, to effect a smaller pressure drop in the direction of flow through the pump than in an opposite direction of flow.

2. The displacement pump according to claim 1, wherein a wall of the pumping chamber has a deformable portion which comprises at least one flexible diaphragm, and drive means operatively associated to said diaphragm for imparting an oscillating movement to said diaphragm and cause fluid enclosed in the pumping chamber to pulsate.

3. The displacement pump according to claim 2, wherein the drive means is a portion of a drive unit, the frequency of the diaphragm oscillating movement imparted by the drive unit being selected to provide a mechanical oscillating resonance which is dependent at least on the mechanical resilience of the oscillating diaphragm and any resilient elements coupled to the diaphragm.

4. The displacement pump according to claim 1, wherein at least a portion of the pump housing and said flow control means constitute integral parts of a single structural piece.

5. The displacement pump according to claim 1, wherein the pump is constructed of silicon manufactured by means of a microworking process.

6. A displacement pump comprising:

a pump housing with a pumping chamber having a variable volume for providing pumping action, said pumping chamber having an inlet and an outlet for a fluid to be pumped wherein a flow passage from the inlet to the outlet is substantially open during the pumping cycle;

a flow control arrangement for controlling the direction of flow through the pump, said flow arrangement comprising a flow controlling means in said inlet and said outlet;

said flow controlling means having one diffuser inlet portion and one diffuser portion as seen in a direction of flow through the pump and each of said flow controlling means includes a rounded shape at inlet regions forming a smooth transition from a surrounding wall;

said diffuser inlet portion having walls admitting a converging flow creating a pressure drop from a pressure maximum at an entrance of the flow controlling means, to an entrance of the diffuser portion;

said diffuser portion having diverging walls causing a substantially diverging flow and a pressure increase; and said flow controlling means being adapted, for a given flow, to effect a smaller pressure drop in the direction of flow through the pump than in an opposite direction of flow.

7. A displacement pump comprising:

a pump housing with a pumping chamber having a variable volume for providing pumping action, said pumping chamber having an inlet for receiving fluid and an outlet for discharging fluid to be pumped;

fixed geometry inlet flow control means for controlling the flow into the pump, said inlet flow control means includes a diverging flow passage for supplying fluid to said pump; and fixed geometry outlet flow control means for discharging the flow from the pump, said outlet flow control means includes a diverging flow passage for discharging the flow of fluid from said pump;

said fixed geometry inlet flow control means and said fixed geometry outlet flow control means being adapted, for a given net flow, to effect a smaller pressure drop in the direction of the net flow through the pump than in an opposite direction of the net flow.

8. The displacement pump according to claim 7, wherein said fixed geometry inlet flow control means includes an inlet area having a predefined volume extending along a length of said diverging flow passage that reduces to a constricted area and thereafter expands into a diverging area for providing a diffuser effect as fluid is supplied to said pumping chamber.

9. The displacement pump according to claim 7, wherein said fixed geometry outlet flow control means includes an inlet area having a predefined volume extending along a length of said diverging flow passage that reduces to a constricted area and thereafter expands into a diverging area for providing a diffuser effect as fluid is discharged from said pumping chamber.

10. A displacement pump comprising:

a pump housing with a pumping chamber having a variable volume for providing pumping action, said pumping chamber having an inlet for receiving fluid and an outlet for discharging fluid to be pumped;

inlet conduit for supplying fluid to said pump; and fixed geometry outlet flow control means for discharging the flow from the pump, said fixed geometry outlet flow control means includes a diverging flow passage for discharging the flow of fluid from said pump;

said inlet conduit and said fixed geometry outlet flow control means being adapted, for a given net flow, to effect a smaller pressure drop in the direction of the net flow through the pump than in an opposite direction of the net flow.

11. A displacement pump comprising:

a pump housing with a pumping chamber having a variable volume for providing pumping action, said pumping chamber having an inlet for receiving fluid and an outlet for discharging fluid to be pumped;

fixed geometry inlet flow control means for controlling the flow into the pump, said fixed geometry inlet flow control means includes a diverging flow passage for supplying fluid to said pump; and outlet flow conduit for discharging the flow of fluid from said pump;

said fixed geometry inlet flow control means and said outlet flow conduit being adapted, for a given net flow, to effect a smaller pressure drop in the direction of the net flow through the pump than in an opposite direction of the net flow.

12. A displacement pump comprising:

a pump housing with a pumping chamber having a variable volume for providing pumping action, said pumping chamber having an inlet for receiving fluid and an outlet for discharging fluid to be pumped;

fixed geometry inlet flow control means for controlling the flow into the pump, said fixed geometry inlet flow control means includes a diverging flow passage for supplying fluid to said pump; and fixed geometry outlet flow control means for discharging the flow from the pump, said fixed geometry outlet flow control means includes a diverging flow passage for discharging the flow of fluid from said pump;

said fixed geometry inlet flow control means and said fixed geometry outlet flow control means being arranged in series relative to each other to supply fluid to said pumping chamber through a diverging flow passage and for discharging fluid from said pumping chamber through a diverging flow passage to effect a smaller pressure drop in the direction of a net flow through the pump than in an opposite direction of the net flow.

13. The displacement pump according to claim 12, wherein said fixed geometry inlet flow control means includes an inlet area having a predefined volume extending along a length of said diverging flow passage that reduces to a constricted area and thereafter expands into a diverging area for providing a diffuser effect as fluid is supplied to said pumping chamber.

14. The displacement pump according to claim 12, wherein said fixed geometry outlet flow control means includes an inlet area having a predefined volume extending along a length of said diverging flow passage that reduces to a constricted area and thereafter expands into a diverging area for providing a diffuser effect as fluid is discharged from said pumping chamber.

* * * * *